US006614327B2

(12) United States Patent
Saito et al.

(10) Patent No.: US 6,614,327 B2
(45) **Date of Patent: *Sep. 2, 2003**

(54) FILTER APPARATUS, DUPLEXER, AND COMMUNICATION APPARATUS

(75) Inventors: Kenji Saito, Ishikawa-gun (JP); Hiroki Wakamatsu, Kyoto (JP)

(73) Assignee: Murata Manufacturing Co. Ltd (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/078,220

(22) Filed: Feb. 15, 2002

(65) Prior Publication Data

US 2002/0118080 A1 Aug. 29, 2002

(30) Foreign Application Priority Data

Feb. 28, 2001 (JP) ..... 2001-054571

(51) Int. Cl.[7] ..... H01P 1/201
(52) U.S. Cl. ..... 333/202; 333/134; 333/219.1
(58) Field of Search ..... 333/202, 212, 333/219.1, 222, 134, 219

(56) References Cited

U.S. PATENT DOCUMENTS 4,578,655 A * 3/1986 Etienne et al. ..... 333/202
5,783,979 A * 7/1998 Andoh et al. ..... 333/202
6,002,311 A * 12/1999 Wey et al. ..... 333/219.1
6,081,175 A * 6/2000 Duong et al. ..... 333/212
6,111,478 A * 8/2000 Furutani et al. ..... 333/174
6,433,652 B1 * 8/2002 Hattori et al. ..... 333/134
6,472,952 B1 * 10/2002 Sakai et al. ..... 333/126
6,472,955 B2 * 10/2002 Saito et al. ..... 333/134

FOREIGN PATENT DOCUMENTS

EP 1091441 A2 * 4/2001 ..... H01P/1/205

* cited by examiner

*Primary Examiner*—Seungsook Ham
(74) *Attorney, Agent, or Firm*—Dickstein, Shapiro, Morin & Oshinsky, LLP.

(57) ABSTRACT

A dual-mode resonator including a conductive cavity that houses a conductive bar and a dielectric core through which the conductive bar is inserted duplexes and couples a TEM mode generated by the cavity and the conductive bar, and a TM mode generated by the cavity and the dielectric core. A TEM single-mode resonator is formed of a cavity body and a conductive bar. The dual-mode resonator and the TEM single-mode resonator form a filter apparatus.

8 Claims, 8 Drawing Sheets

FILTER APPARATUS, DUPLEXER, AND COMMUNICATION APPARATUS

BACKGROUND OF THE INVENTION

1. Field of the Invention

The present invention relates to a filter apparatus having a plurality of resonators, a duplexer, and a communication apparatus, such as a base station communication apparatus.

2. Description of the Related Art

In the related art, resonators used in the microwave band and capable of handling relatively large power include a cavity resonator and a semi-coaxial resonator. A semi-coaxial resonator is also known as a coaxial cavity resonator, and is relatively useful to form a compact filter etc. because of its relatively high Q factor and because it is more compact than a cavity resonator.

FIG. 11 is a top view of a filter including semi-coaxial resonators, with a cavity lid removed. A cavity body 1 having an opening, which is covered by a cavity lid, includes cylindrical conductive bars 4 in the centers of the cavities of the resonators in order to form a plurality of semi-coaxial resonators. Adjacent resonators are coupled to each other by known arrangements.

A filter having TM dual-mode dielectric resonators may also be useful to provide a compact resonator.

FIG. 12 shows an example of a filter using TM dual-mode dielectric resonators. In FIG. 12, a cavity body 1 includes a cruciform dielectric core 3 in each resonator space so as to provide multiplexing of the two perpendicular TM modes.

With the advent of micro-cell cellular mobile communication systems such as cellular phones, the demand for more compact filters in base stations has increased. In addition, as the number of installed filters has increased, more cost-effective filters have been increasingly required.

However, a filter having semi-coaxial resonators still requires a large volume for each resonator, and thus the overall filter apparatus cannot be reduced in size. A filter apparatus having TM dual-mode resonators includes resonators formed of dielectric cores in all stages, and therefore may be compact as a whole; however, it requires a complicated manufacturing process for integral molding, thereby making it difficult to achieve cost-effectiveness.

SUMMARY OF THE INVENTION

Accordingly, the present invention addresses the above problems by providing a compact and low-cost filter apparatus, a duplexer, and a communication apparatus incorporating these features.

To this end, in a first aspect of the present invention, a filter apparatus includes a dual-mode resonator and a TEM single-mode resonator. The dual-mode resonator includes a conductive cavity that houses a conductive bar having at least one end electrically connected to the cavity and a dielectric core through which the bar is inserted. The dual-mode resonator duplexes and couples a TEM mode generated by the cavity and the bar and a TM mode generated by the cavity and the dielectric core. The TEM single-mode resonator includes a conductive cavity which houses a conductive bar having at least one end electrically connected to the cavity.

A dual-mode, i.e., both TEM-mode and TM-mode, resonator may be used to achieve a compact filter apparatus. In addition, the dual-mode resonator is combined with a TEM single-mode resonator to construct a filter apparatus having a predetermined number of stages of resonators within a limited space at low cost.

In another aspect of the present invention, a duplexer includes a reception filter and a transmission filter. The reception filter includes a plurality of dual-mode resonators as described above, wherein predetermined resonators between adjacent dual-mode resonators are coupled with each other. The transmission filter includes a dual-mode resonator and a TEM single-mode resonator, wherein predetermined resonators between adjacent resonators are coupled with each other. The duplexer further includes a shared input/output port which provides an input to the reception filter and an output from the transmission filter.

A reception filter which generally requires a greater number of stages of resonators than a transmission filter is formed of a plurality of dual-mode resonators, and can therefore be reduced in size. A transmission filter includes a dual-mode resonator and a TEM single-mode resonator, and can thus provide the same resonator length in the alignment direction as that in the reception filter, while satisfying required frequency characteristics. Accordingly, a duplexer having such a reception filter and transmission filter can be made compact, in which the lengths of the resonators in the reception and transmission filters can be uniform in an alignment direction of the resonators. The duplexer can therefore be readily assembled into a communication device.

The duplexer may further include a low-noise amplifier circuit for amplifying a reception signal output from the reception filter, wherein the low-noise amplifier circuit, the transmission filter, and the reception filter are housed by a housing. This provides a shorter distance from the reception filter to the low-noise amplifier circuit, thereby suppressing incoming noise, so that a reception signal having a high signal-to-noise ratio can be output from the duplexer.

The duplexer may further include a low-pass filter between the shared input/output port and an antenna port, for transmitting a signal component in the transmission and reception frequency bands, and blocking a signal component in the frequency regions higher than the transmission and reception frequency bands. This can suppress emission of unwanted signals due to spurious modes.

In still another aspect of the present invention, a communication apparatus, such as a base station communication apparatus, includes the aforementioned duplexer, and a transmitter and a receiver which are connected to the duplexer. A base station communication apparatus, for example, can thus be made compact and cost-effective.

BRIEF DESCRIPTION OF THE DRAWINGS

Other features and advantages of the present invention will become apparent from the following description of embodiments of the invention which refers to the accompanying drawings.

DETAILED DESCRIPTION OF EMBODIMENTS OF THE INVENTION

The structure of a filter apparatus according to a first embodiment of the present invention is now described with reference to FIGS. 1 to 6.

Figure 1:
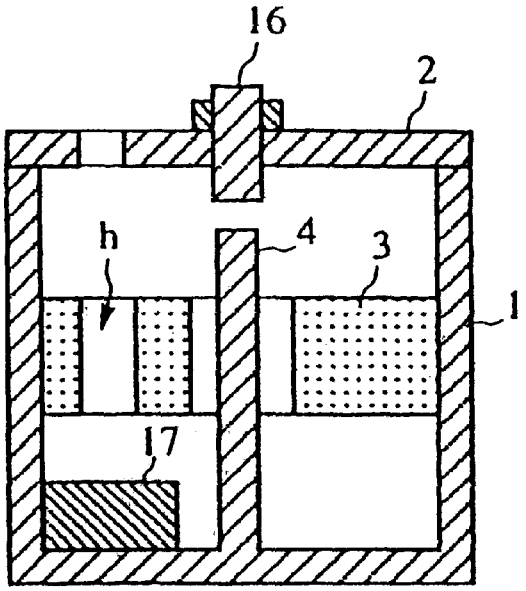
FIG. 1 is a cross-sectional view of a dual-mode resonator in a filter apparatus according to a first embodiment of the present invention.

FIG. 1 is a cross-sectional view of a dual-mode resonator. In FIG. 1, a cavity body 1 has an opening which is covered with a cavity lid 2. The cavity lid 2 includes a frequency-adjusting screw 16 in the center thereof for adjusting the resonant frequency by providing a predetermined gap length between the distal end of a conductive bar 4 and the inner surface of the cavity lid 2.

Both lengthwise end surfaces of a dielectric core 3 are bonded to inner wall surfaces of the cavity body 1. For example, the end surfaces of the dielectric core 3, which have been metalized with Ag electrodes, are soldered and bonded to the inner wall surfaces of the cavity body 1 so that the dielectric core 3 is positioned in the center of the cavity space. The cavity body 1 and the cavity lid 2 are produced by casting or cutting a metal material, or by depositing a conductive film on a ceramic or resin member.

A coupling-adjusting block 17 is installed in a predetermined position on the internal bottom surface of the cavity body 1. The coupling-adjusting block 17 may be integrally molded on the cavity body 1, or may be formed by screwing a rectangular metal block thereto. The coupling-adjusting block 17 allows the amount of coupling between a TEM mode and a TM mode, described later, to be adjusted. The dielectric core 3 has a coupling-adjusting hole h formed therein. A dielectric bar (not shown) can be externally inserted through the coupling-adjusting hole h, and, depending upon the amount of insertion, the amount of coupling between a TEM mode and a TM mode is adjusted.

Figure 2A:
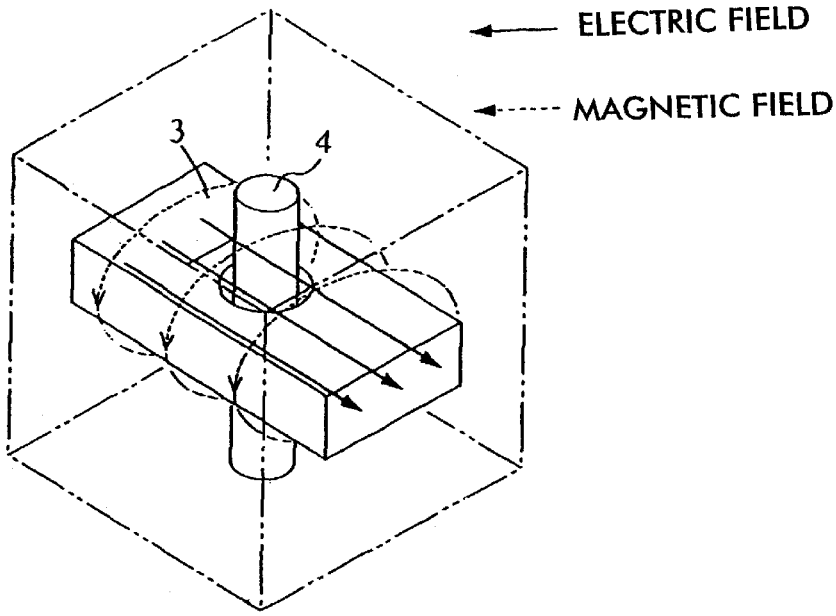
FIGS. 2A to 2C are exemplary electromagnetic field distributions in resonant modes of the dual-mode resonator in the filter apparatus shown in FIG. 1.
Figure 2B:
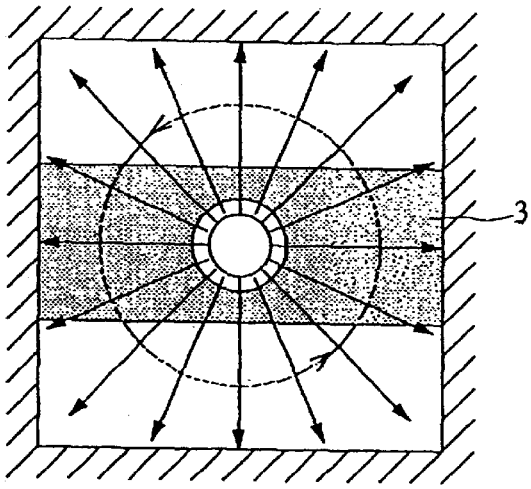
Figure 2C:
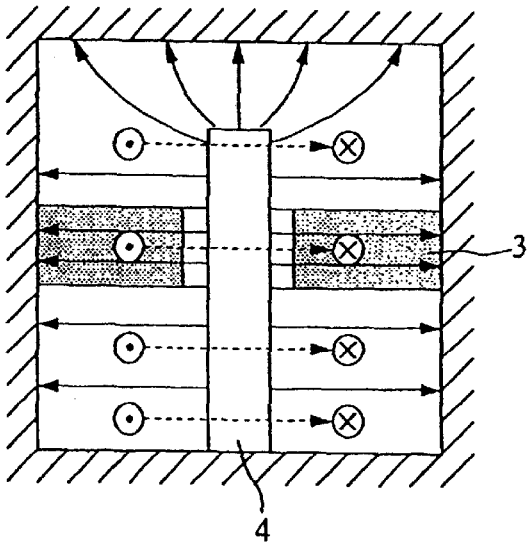

FIGS. 2A to 2C show exemplary electromagnetic field distributions in the modes of the dual-mode resonator. In FIGS. 2A to 2C, solid arrows indicate electric field vectors, and broken arrows indicate magnetic field vectors. FIG. 2A is the electromagnetic field distribution in a TM mode generated by the dielectric core 3 and the cavity. In this mode, the electric field vectors are in the lengthwise direction of the dielectric core 3, and the magnetic vectors loop perpendicularly to the lengthwise direction of the dielectric core 3. Although the dielectric core 3 is rectangular, a cylindrical coordinate system is used herein for mode notation, and the number of waves in the electric field strength distribution is expressed as TMθrh, where value h is in the propagation direction, value r is in the in-plane radial direction perpendicular to the propagation direction, and value θ is in the in-plane circumferential direction perpendicular to the propagation direction. The mode shown in FIG. 2A can thus be expressed as a TM010 mode, but this mode is different from a standard TM010 mode. In this example, since the dielectric core 3 is not cylindrical, and the conductive bar 4 is located in the center of the dielectric core 3, this mode is a quasi TM010 mode.

FIG. 2B is a top view of a semi-coaxial resonator formed of a cavity and a conductive bar, and FIG. 2C is a front view of the semi-coaxial resonator shown in FIG. 2B. This mode is a TEM mode in which the electric field vectors are directed in the radial direction from the conductive bar towards the inner wall surfaces of the cavity, while the magnetic field vectors loop in the circumferential direction about the conductive bar. However, unlike a standard semi-coaxial resonator, the semi-coaxial resonator shown in FIGS. 2B and 2C is loaded by the dielectric core 3, and a gap exists between the top of the conductive bar 4 and the upper surface of the cavity. Therefore, this mode is a quasi semi-coaxial resonator mode.

The resonator parts shown in FIG. 1 are appropriately sized so that the resonator can be used as a 2 GHz band resonator having a TM mode resonant frequency of 1910 MHz and a TEM mode resonant frequency of 2155 MHz.

In FIGS. 2A to 2C, since the strengths of the electric field vectors in the lengthwise direction of the dielectric core 3 are balanced in the TM mode and the TEM mode, these modes are not coupled with each other, if unchanged. Therefore, the electric field strengths in the two modes are made unbalanced, so that the two modes are coupled with each other.

Figure 3:
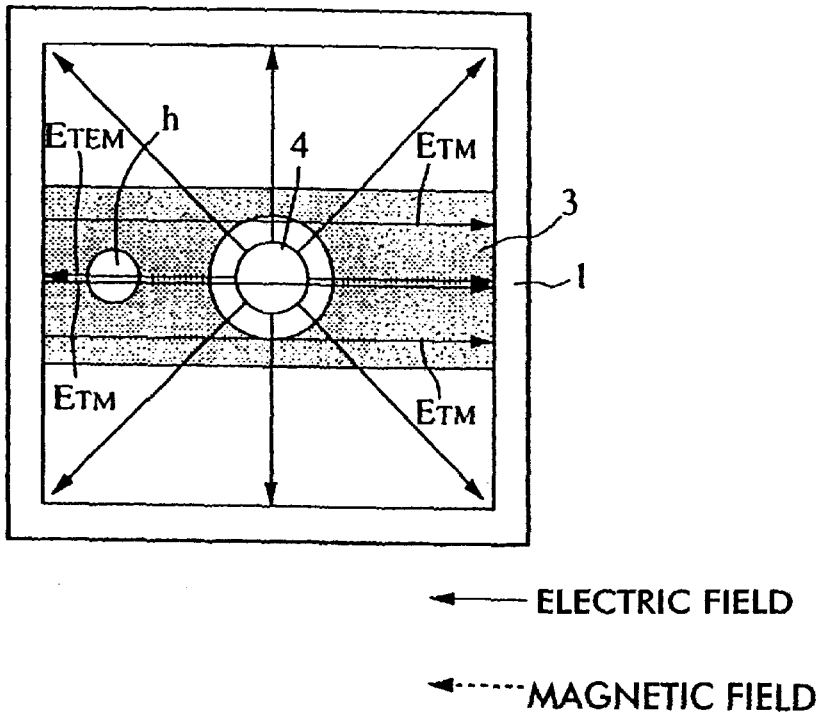
FIG. 3 is a top view showing that the two resonant modes of the dual-mode resonator are coupled with each other.

FIG. 3 is a top view of an example of a mechanism for coupling the two modes with each other, showing the cavity body 1 after removal of the cavity lid 2. The TEM-mode electric field vectors $E_{TEM}$ are directed in the radial direction from the conductive bar 4, and the TM-mode electric field vectors $E_{TM}$ are directed along the dielectric core 3. In order to couple the two modes with each other, the electric field strength from one lengthwise end of the dielectric core 3 to the center portion (the conductive bar 4) and the electric field strength from the other end of the dielectric core 3 to the center portion are made unbalanced. For this purpose, a coupling-adjusting hole h shown in FIG. 3 is provided, thereby causing the electric field strengths in the vicinity thereof to be asymmetrical. This results in coupling of the TEM mode and the TM mode. The amount of coupling depends upon the size (inner diameter or depth) of the coupling-adjusting hole h, or the amount by which a dielectric bar (not shown) is inserted into the coupling-adjusting hole h.

According to the first embodiment, a gap exists between the hole in the center of the dielectric core 3 and the conductive bar 4, thereby suppressing conductor loss due to current flowing in the conductive bar 4 and increasing the Q factor of the resonator. This gap is not essential, and, in some embodiments, a hole formed in the dielectric core may be engaged with a conductive bar.

Figure 4A:
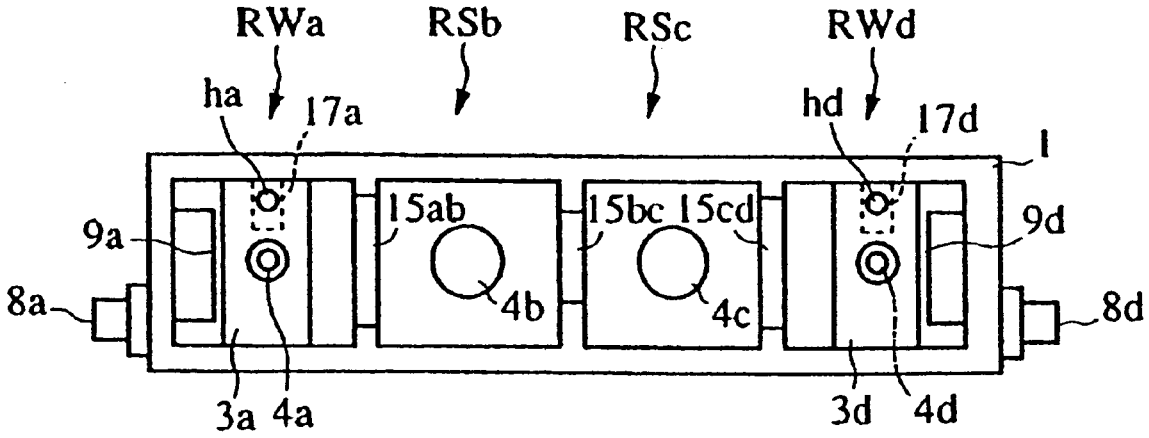
FIGS. 4A and 4B are top views of two implementations of the filter apparatus according to the first embodiment.
Figure 4B:
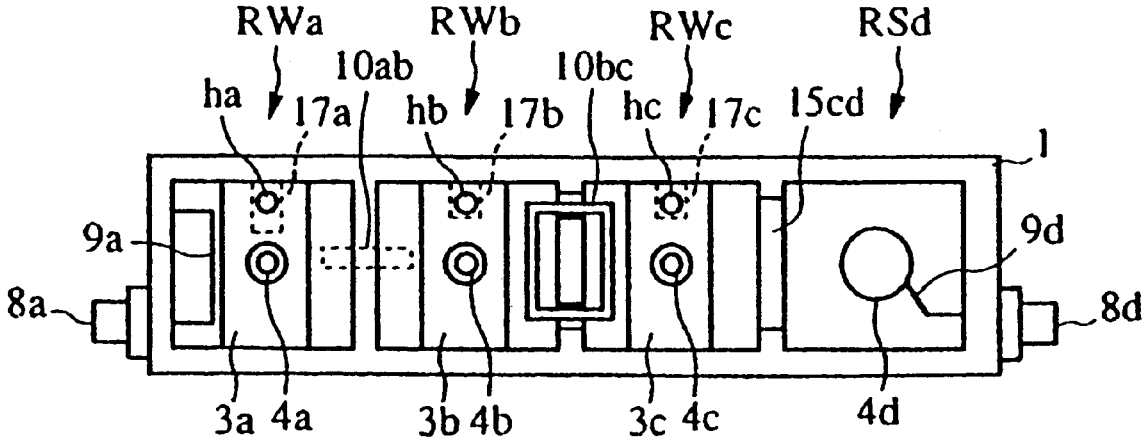
Figure 5:
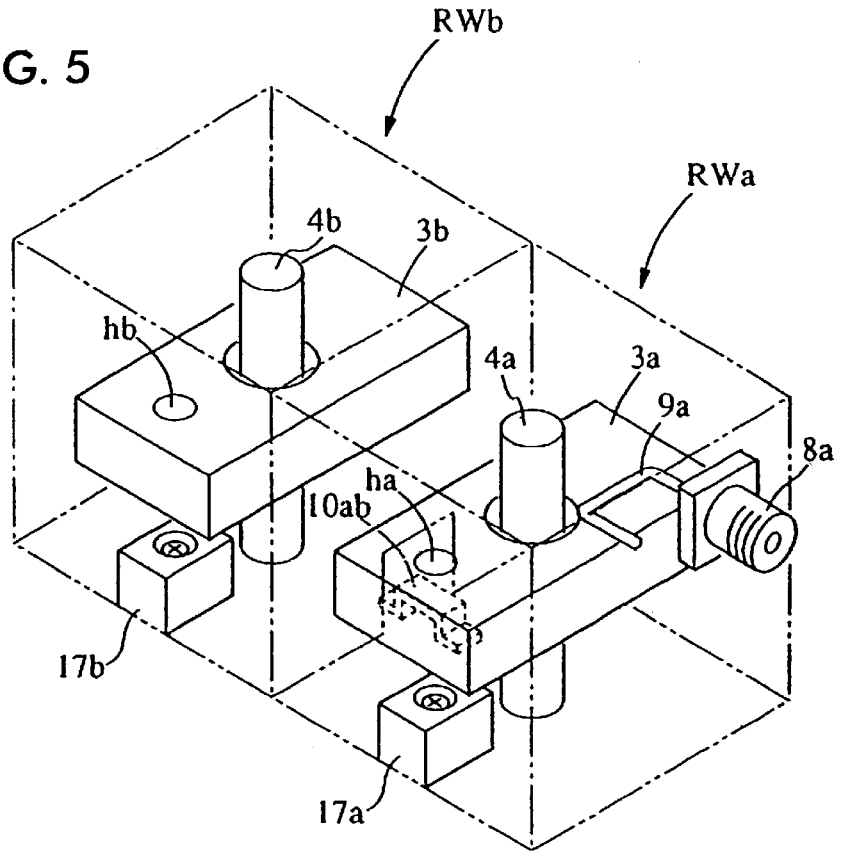
FIG. 5 is a perspective view of the structure of two dual-mode resonators which are coupled with each other.
Figure 6:
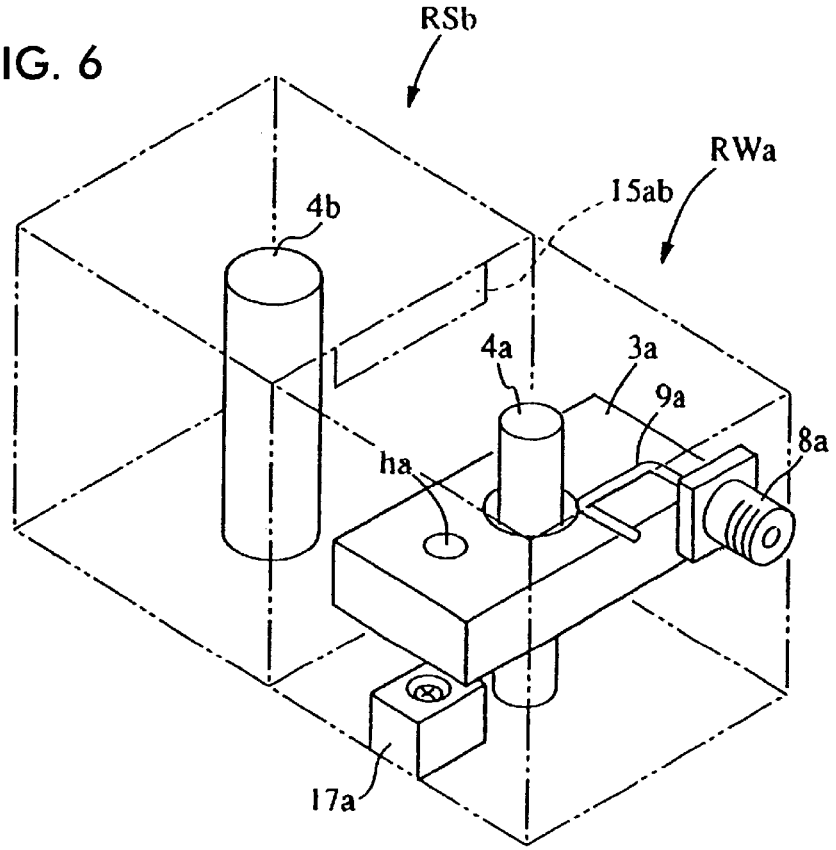
FIG. 6 is a perspective view of the structure of a dual-mode resonator and a TEM single-mode resonator which are coupled with each other.

FIGS. 4A and 4B are top views of two types of filter apparatuses, from which cavity lids have been removed. FIG. 5 is a perspective view of the structure of resonators RWa and RWb shown in FIG. 4B. FIG. 6 is a perspective view of the structure of resonators RWa and RSb shown in FIG. 4A. In FIGS. 5 and 6, cavity spaces are indicated by two-dot chain lines.

An aluminum cavity body 1 is partitioned into four sections, by way of example. Cylindrical conductive bars 4*a*, 4*b*, 4*c*, and 4*d* are integrally formed on the cavity body 1. Each of the conductive bars 4*a*, 4*b*, 4*c*, and 4*d* make up a TEM mode resonator together with the cavity. In FIGS. 4A and 4B, each of a plurality of substantially rectangular dielectric cores 3*a*, 3*b*, 3*c*, and 3*d* makes up a TM mode resonator together with the cavity.

In FIG. 4A, the resonators RWa and RWb are dual-mode resonators, and the resonators RSb and RSc are TEM single-mode resonators. Coupling loops 9*a* and 9*d* have first ends bonded to the inner wall surface of the cavity body 1, and second ends connected to the central conductors of coaxial connectors 8*a* and 8*d*, respectively. Coupling windows 15*ab*, 15*bc*, and 15*cd* are provided at the boundaries between the adjacent cavity spaces.

The coupling loop 9*a* is coupled with a TM mode generated by the dielectric core 3*a*, and this TM mode is coupled with a TEM mode generated by the conductive bar 4*a*. This TEM mode is coupled with a TEM mode generated by the conductive bar 4*b* via the coupling window 15*ab*. This TEM mode is further coupled with a TEM mode generated by the conductive bar 4*c* via the coupling window 15*bc*. This TEM mode is coupled with a TEM mode generated by the conductive bar 4*d* via the coupling window 15*cd*. This TEM mode is coupled with a TM mode generated by the dielectric core 3*d*. The coupling loop 9*d* is coupled with this TM mode. Eventually, with the structure shown in FIG. 4A, the two dual-mode resonators and the two TEM single-mode resonators, that is, a total of six stages of resonators, are in turn coupled with each other, and act as a filter having a band-pass characteristic.

In FIG. 4B, dual-mode resonators RWa, RWb, and RWc, and a TEM single-mode resonator RSd, that is, a total of seven stages of resonators, form a filter. Specifically, the coupling loop 9*a* is coupled with a TM mode generated by the dielectric core 3*a*, and this TM mode is coupled with a TEM mode generated by the conductive bar 4*a*. This TEM mode is coupled with a TEM mode generated by the conductive bar 4*b* via a coupling loop 10*ab*. This TEM mode is coupled with a TM mode generated by the dielectric core 3*b*. This TM mode is coupled with a TM mode generated by the dielectric core 3*c* via a coupling loop 10*bc*. This TM mode is coupled with a TEM mode generated by the conductive bar 4*c*. This TEM mode is coupled with a TEM mode generated by the conductive bar 4*d* via the coupling window 15*cd*. The coupling loop 9*d* connects the conductive bar 4*d* to the central conductor of the coaxial connector 8*d*. Therefore, the coupling loop 9*d* is coupled with the TEM mode generated by the conductive bar 4*d*.

The coupling loop 10*ab* is not coupled with either the TM mode generated by the dielectric core 3*a* or the TM mode generated by the dielectric core 3*b*, and these two TM modes are not directly coupled with each other. The coupling loop 10*bc* is not coupled with either the TEM mode generated by the conductive bar 4*b* or the TEM mode generated by the conductive bar 4*c*, and these two TEM modes are not directly coupled with each other.

Figure 7A:
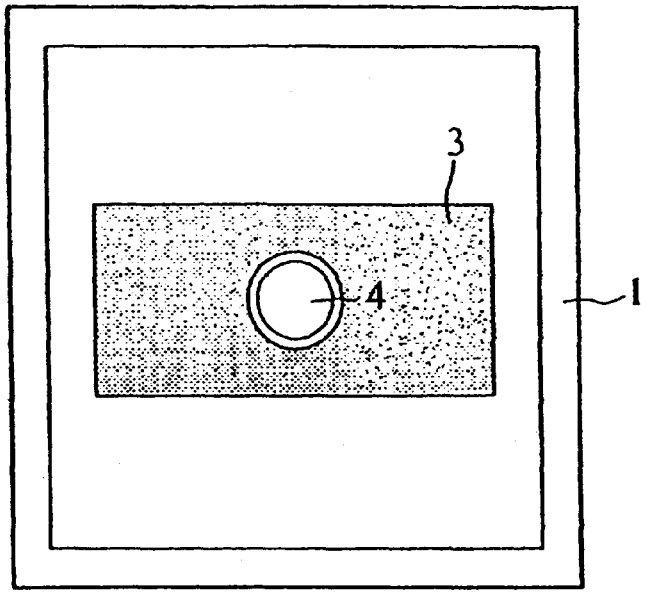
FIGS. 7A and 7B are a top view and a longitudinal cross-sectional view of a dual-mode resonator, respectively, according to a second embodiment of the present invention.
Figure 7B:
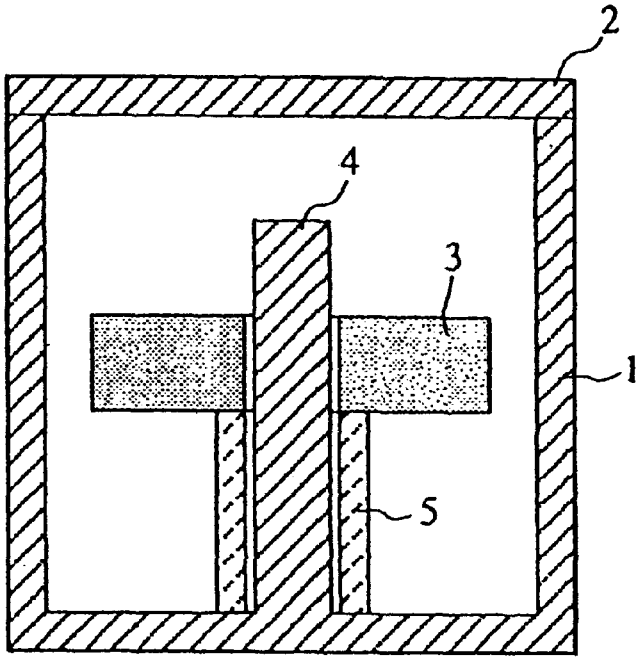

FIG. 7A is a top view of a filter apparatus according to a second embodiment of the present invention with a cavity lid removed, and FIG. 7B is a longitudinal cross-sectional view of the filter apparatus. In the second embodiment, the end surfaces of the dielectric core 3 are spaced apart from the inner wall surfaces of the cavity. In FIG. 7B, a support 5 for supporting the dielectric core 3 is a tube made of a material having a low dielectric constant, and is bonded to the dielectric core 3. The conductive bar 4 is inserted through the dielectric core 3 to which the support 5 is attached, whereby the dielectric core 3 is fixed in substantially the center of the cavity.

If gaps exist between the lengthwise end surfaces of the dielectric core 3 and the inner wall surfaces of the cavity, the electric field strength also varies in the propagation direction, so that this resonant mode can be expressed as the TM01δ mode, where δ is a number less than 1, meaning that although complete waves are not carried in the propagation direction, the strength varies.

With this structure, electrostatic capacitance is generated in the gaps between the end surfaces of the dielectric core 3 and the inner wall surfaces of the cavity, thereby reducing the electrostatic capacitance between the two inner wall surfaces of the cavity which face the lengthwise end surfaces of the dielectric core 3. This introduces an increase in the size of the cavity (distance between the facing inner wall surfaces of the cavity) in order to obtain the required resonant frequency in a TM mode. However, the current density of the current flowing in the cavity is reduced, thereby increasing the Q factor of the resonator.

The structure of a duplexer according to a third embodiment of the present invention is now described with reference to FIG. 8.

Figure 8:
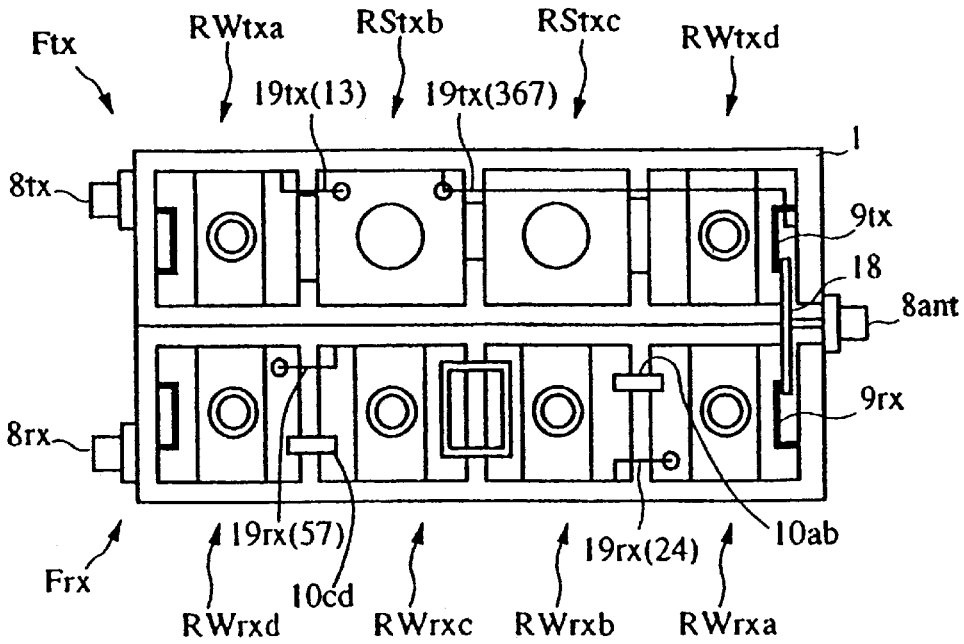
FIG. 8 is a cross-sectional view of a duplexer according to a third embodiment of the present invention.

In FIG. 8, a transmission filter Ftx includes dual-mode resonators RWtxa and RWtxd, and TEM single-mode resonators RStxb and RStxc. A reception filter Frx includes dual-mode resonators RWrxa, RWrxb, RWrxc, and RWrxd. The duplexer further includes a coaxial connector 8*tx* for inputting a transmission signal, a coaxial connector 8*ant* for connecting an antenna cable, and a coaxial connector 8*rx* for outputting a reception signal.

A TEM mode of the dual-mode resonator RWrxc is coupled with a TEM mode of the dual-mode resonator RWrxd via a coupling loop 10*cd*. A coupling loop 9*rx* is coupled to a TM mode of the dual-mode resonator RWrxa. A coupling loop 9*tx* is coupled to a TM mode of the dual-mode resonator RWtxd. A combining conductor 18 connects first ends of the coupling loops 9*tx* and 9*rx* with each other, and combines a transmission signal with a reception signal with a predetermined phase to connect the resulting signal to the central conductor of the antenna coaxial connector 8*ant*.

In FIG. 8, a skip-coupling conductor 19*rx*(24) provides magnetic field coupling into a TEM mode of the dual-mode resonator RWrxa, and magnetic field coupling into a TM mode of the dual-mode resonator RWrxb. The skip-coupling conductor 19*rx*(24) enables the resonators at the second and fourth stages in the reception filter Frx to be coupled with each other. A skip-coupling conductor 19*rx*(57) provides magnetic field coupling into a TEM mode of the dual-mode resonator RWrxd, and magnetic field coupling into a TM mode of the dual-mode resonator RWrxc. The skip-coupling conductor 19*rx*(57) enables the resonators at the fifth and seventh stages in the reception filter Frx to be coupled with each other. In this way, resonators are coupled every other stage, and the polarity of the coupling is selected, thereby yielding a large attenuation in the vicinity of the reception band.

A skip-coupling conductor 19*tx*(13) allows a TM mode of the dual-mode resonator RWtxa to be coupled with a TEM mode of the TEM single-mode resonator RStxb. The resonators at the first and third stages are thus coupled with each other, thereby yielding a large attenuation around the reception band in the transmission filter Ftx.

A skip-coupling conductor 19*tx*(367) allows a TM mode of the TEM single-mode resonator RStxb to be coupled with a TM mode of the dual-mode resonator RWtxd, and further with the coupling loop 9*tx*. The skip-coupling conductor 19*tx*(367) enables the resonators at the third and sixth stages to be coupled with each other. At the same time, it allows the resonator at the third stage and the output coupling loop at the seventh stage to be coupled with each other. In this way, the resonators at the third and sixth stages are coupled with each other, and the resonator at the third stage and the output coupling loop are coupled with each other. This yields a large attenuation in the vicinity of the high frequency region and in the vicinity of the low frequency region of the transmission band.

Therefore, skip-coupling conductors may be provided at predetermined positions in order to readily couple predetermined resonators in a plurality of stages of resonators with each other.

The structure of a communication apparatus according to a fourth embodiment of the present invention is now described with reference to FIGS. 9 and 10. The described apparatus is a base station in this example, but the invention is equally applicable to a portable communication apparatus.

Figure 9:
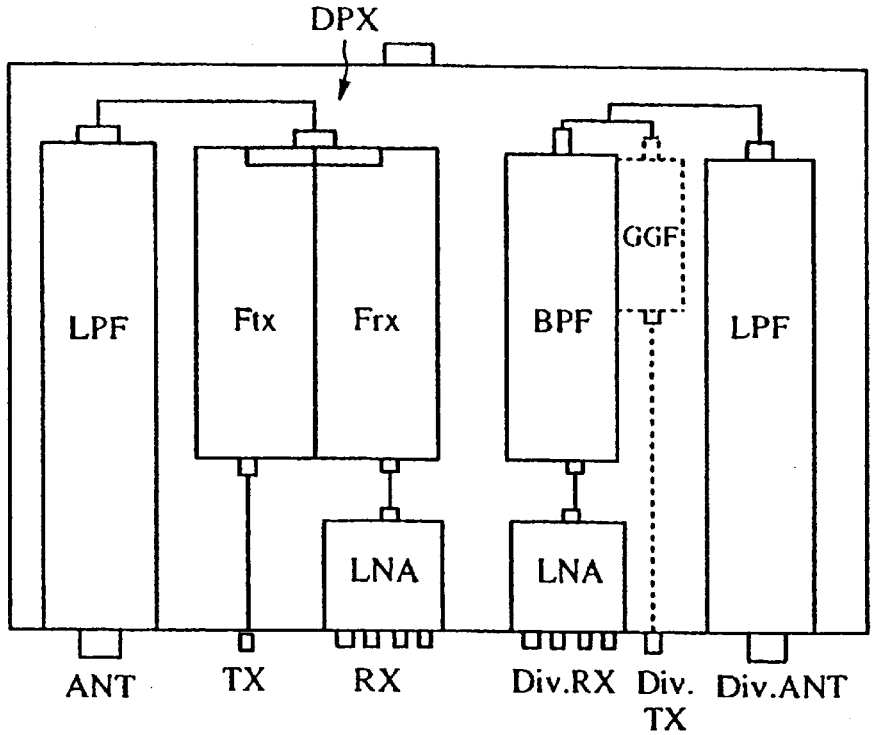
FIG. 9 is a block diagram of a base station communication apparatus according to a fourth embodiment of the present invention.
Figure 10:
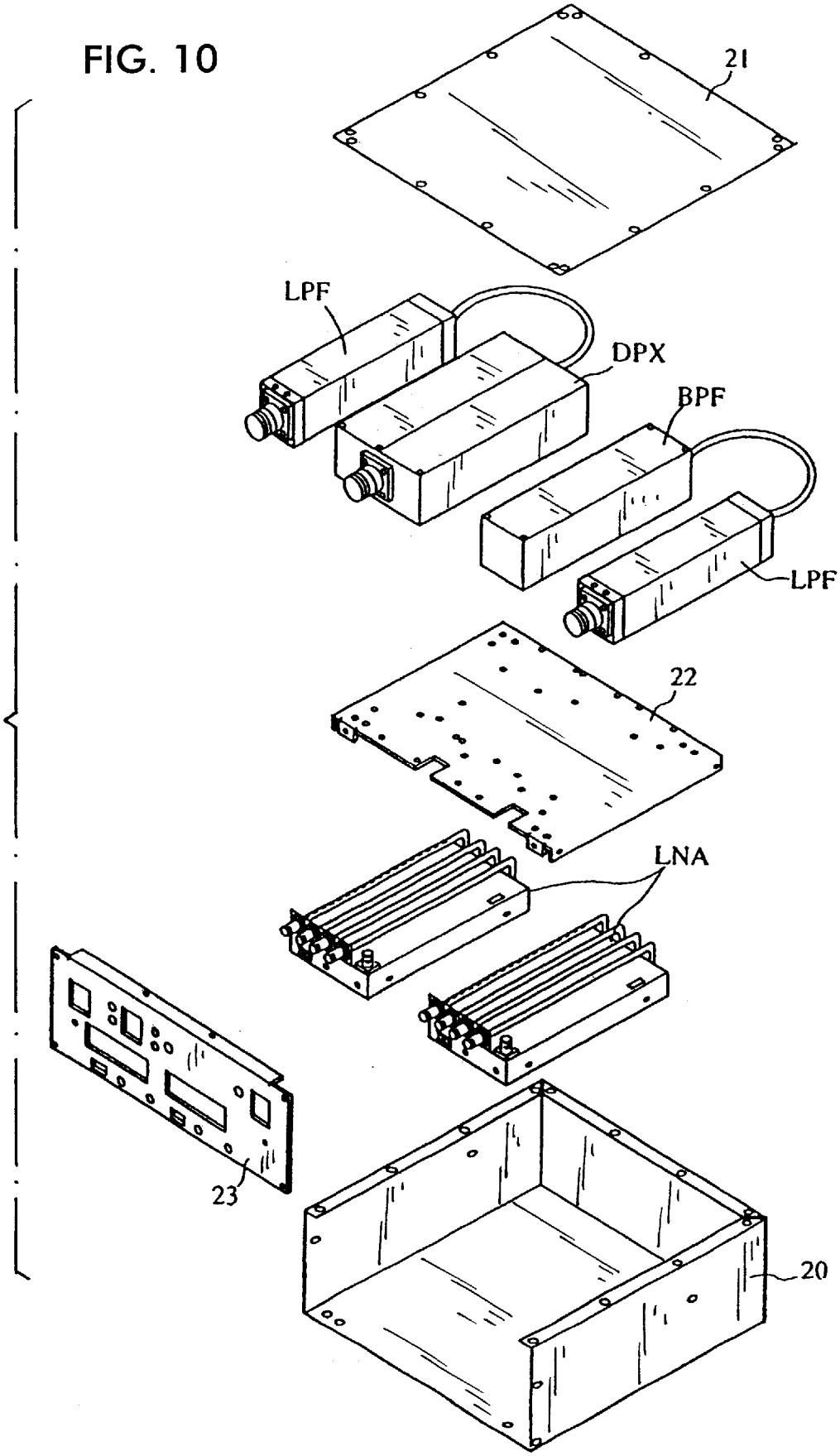
FIG. 10 is an exploded perspective view of the base station communication apparatus shown in FIG. 9.
Figure 11:
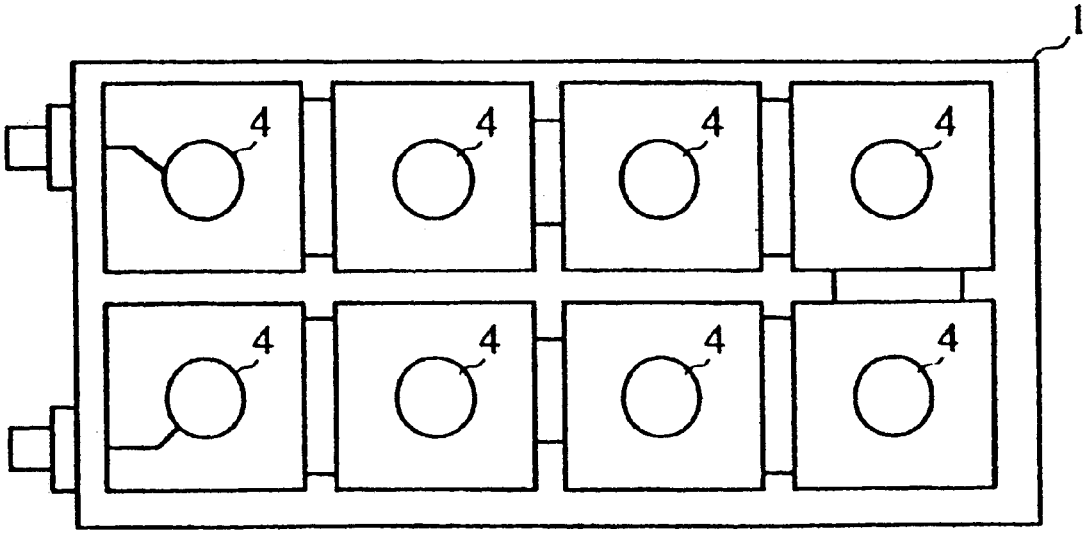
FIG. 11 PRIOR ART
FIG. 11 is a structural view of a conventional filter apparatus.
Figure 12:
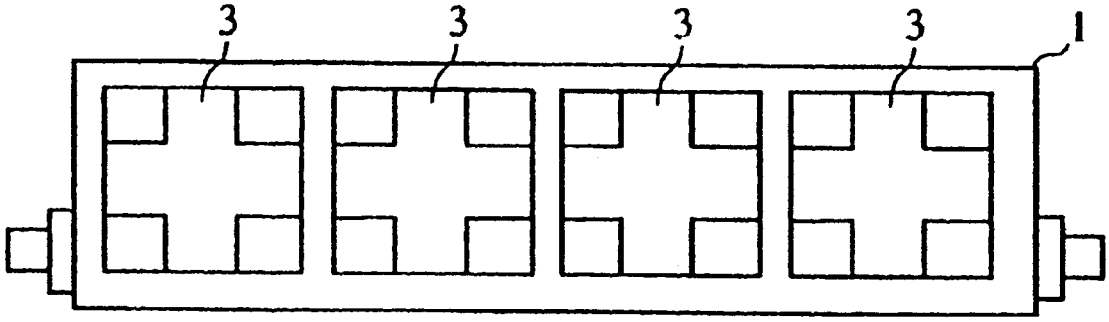
FIG. 12 PRIOR ART
FIG. 12 is a structural view of another conventional filter apparatus.

FIG. 9 illustrates a connection relationship between the components, and FIG. 10 is an exploded perspective view of the overall apparatus. A coaxial connector for connection to an antenna cable is indicated by ANT, a coaxial connector to be connected to a transmitter is indicated by TX, and a coaxial connector to be connected to a receiver is indicated by RX. A coaxial connector for connection to another space-diversity antenna cable is indicated by Div.ANT. The communication apparatus includes low-pass filters LPF which transmit signal components in the transmission and reception frequency bands and which block signal components in the frequency regions higher than the transmission and reception frequency bands. The two low-pass filters LPF are distributed-constant-type coaxial line filters. A duplexer DPX is the same type as that shown in FIG. 8, and is formed of a transmission filter Ftx and a reception filter Frx. A space-diversity reception filter BPF has the same configuration as that of the reception filter Frx in the duplexer DPX. The communication apparatus further includes a band-pass filter GGF, if necessary or desirable, which transmits a signal component in the transmission frequency band.

A signal transmitted through the band-pass filter GGF is output through the Div.TX terminal. More specifically, radio waves emitted from an antenna (not shown) connected to the coaxial connector ANT are directly received by another space-diversity antenna (not shown) which is connected to the terminal Div.ANT. The received signal is passed through the low-pass filter LPF and the band-pass filter GGF, and is then output from the Div.TX terminal. The output signal is used to monitor the transmission signal.

The communication apparatus further includes low-noise amplifier circuits LNA which amplify the output signal from the reception filter Frx in the duplexer DPX and the reception signal from the space-diversity reception filter BPF, respectively, at a predetermined gain. The amplified signals are distributed into four routes, which are then output from the corresponding coaxial connectors.

In FIG. 10, a chassis 20 houses the two low-noise amplifier circuits LNA installed therein, and an intermediate plate 22 on which the two low-pass filters LPF, the duplexer DPX, and the space-diversity reception filter BPF are seated. A front plate 23 is attached to the side opening of the chassis 20, and the chassis 20 is covered by a lid 21, thus constructing the base station communication apparatus.

The output connectors for the reception filter Frx in the duplexer DPX and for the space-diversity reception filter BPF are directly connected to the coaxial connectors of the low-noise amplifier circuits LNA through cutout portions of the intermediate plate 22. An output signal from each of the low-noise amplifier circuits LNA is led by four coaxial connectors to be output from the front plate 23.

While the present invention has been described with reference to the illustrated embodiments, it is to be understood that the present invention is not limited thereto, and various modifications, variations, and changes are made without departing from the spirit and scope of the invention.

What is claimed is:

1. A filter apparatus comprising:

a dual-mode resonator including a conductive cavity that houses a conductive bar having at least one end electrically connected to the cavity and a dielectric core through which the bar is inserted, wherein said dual-mode resonator duplexes and couples a TEM mode generated by the cavity and the bar and a TM mode generated by the cavity and the dielectric core, wherein a magnetic field of the TM mode is vertical in direction; and a TEM single-mode resonator including a conductive cavity which houses a conductive bar having at least one end electrically connected to said cavity.

2. A duplexer comprising:

a filter apparatus according to claim 1 serving as a transmission filter;

a reception filter including a plurality of dual-mode resonators, each dual-mode resonator including a conductive cavity that houses a conductive bar having at least one end electrically connected to the cavity and a dielectric core through which the bar is inserted, wherein said dual-mode resonator duplexes and couples a TEM mode generated by the cavity and the bar and a TM mode generated by the cavity and the dielectric core, and wherein predetermined resonators are coupled with each other; and a shared input and output port which provides an input for the reception filter and an output for the transmission filter.

3. A duplexer according to claim 2, further comprising a low-noise amplifier circuit for amplifying a reception signal output from the reception filter, wherein the low-noise amplifier circuit, the transmission filter, and the reception filter are housed by a housing.

4. A duplexer according to claim 2, further comprising a low-pass filter between the shared input and output port and an antenna port, for transmitting a signal component in the transmission and reception frequency bands, and blocking a signal component in the frequency regions higher than the transmission and reception frequency bands.

5. A communication apparatus comprising:

the duplexer according to claim 2; and a transmitter and a receiver which are connected respectively to the transmission filter and the reception filter of the duplexer.

6. A filter apparatus according to claim 1, further comprising a coupling adjusting block located within the conductive cavity, the coupling adjusting block adjusting an amount of coupling between the TEM mode and the TM mode.

7. A duplexer according to claim 2, further comprising a skip-coupling conductor for coupling at least two resonators.

8. A dual mode resonator comprising:

a conductive cavity that houses a conductive bar having at least one end electrically connected to the cavity and a dielectric core through which the bar is inserted, wherein said dual-mode resonator duplexes and couples a TEM mode generated by the cavity and the bar and a TM mode generated by the cavity and the dielectric core; and a coupling adjusting block located within the conductive cavity, the coupling adjusting block adjusting an amount of coupling between the TEM mode and the TM mode.

* * * * *